US009849564B2

(12) United States Patent
Brandstetter et al.

(10) Patent No.: US 9,849,564 B2
(45) Date of Patent: Dec. 26, 2017

(54) BACKING PLATE FOR ADHESIVE FLAP WHEELS

(71) Applicants: Josef Brandstetter, Rottenburg (DE); Armando Rios Hernández, Iztapalapa (MX)

(72) Inventors: Josef Brandstetter, Rottenburg (DE); Armando Rios Hernández, Iztapalapa (MX)

(73) Assignees: JOBRA METALL GMBH, Rottenburg (DE); INDUSTRIAS TENAZIT S.A. DE C.V., Iztapalapa, Mexico D.F. (MX)

( * ) Notice: Subject to any disclaimer, the term of this patent is extended or adjusted under 35 U.S.C. 154(b) by 161 days.

(21) Appl. No.: 15/016,633

(22) Filed: Feb. 5, 2016

(65) Prior Publication Data

US 2016/0229033 A1 Aug. 11, 2016

(30) Foreign Application Priority Data

Feb. 5, 2015 (DE) ..... 20 2015 100 548 U

(51) Int. Cl.

| | |
|---|---|
| ***B24D 13/14*** | (2006.01) |
| ***B24D 13/16*** | (2006.01) |
| ***B24D 13/18*** | (2006.01) |
| ***B24D 13/20*** | (2006.01) |

(52) U.S. Cl.

CPC ..... *B24D 13/142* (2013.01); *B24D 13/16* (2013.01); *B24D 13/18* (2013.01); *B24D 13/20* (2013.01)

(58) Field of Classification Search

CPC ..... B24D 13/142; B24D 13/16; B24D 13/18; B24D 13/20

USPC ..... 451/488, 548–551

See application file for complete search history.

(56) References Cited

U.S. PATENT DOCUMENTS

| | | | | |
|---|---|---|---|---|
| 2,027,863 | A * | 1/1936 | Hall | B24D 13/18 15/200 |
| 2,648,178 | A * | 8/1953 | Lyon | B24D 13/142 15/230.18 |
| 3,616,581 | A * | 11/1971 | Johnson et al. | A24D 3/02 15/230.18 |
| 6,299,522 | B1 * | 10/2001 | Lee | B24B 55/102 451/488 |
| 8,562,396 | B1 * | 10/2013 | Piliguian | B24D 9/08 125/15 |
| 2013/0052922 | A1 * | 2/2013 | Ahn | B24D 7/10 451/488 |

FOREIGN PATENT DOCUMENTS

| | | | | |
|---|---|---|---|---|
| DE | 202012100088 U1 * | 2/2012 | ..... | B24B 55/02 |

* cited by examiner

*Primary Examiner* — George Nguyen
(74) *Attorney, Agent, or Firm* — Themis Law

(57) ABSTRACT

A backing plate for abrasive flap wheels, in which openings are configures as slots, which are formed in the outer flange and which are radially open on its outer edge.

4 Claims, 3 Drawing Sheets

BACKING PLATE FOR ADHESIVE FLAP WHEELS

FIELD OF THE INVENTION

The present invention relates to a backing plate for abrasive flap wheels.

BACKGROUND OF THE INVENTION

A backing plate of this kind is known from German utility Patent 20 2012 100 088 to Jobra Metall GmbH, according to which aeration slots are provided in a cone shaped junction ring between the outer flange and the inner part. The slots are directed in an inclined sense with respect to the radial direction. Air deflection wings between the slots ensure a good cooling effect during operation of the grinding wheel.

SUMMARY OF THE INVENTION

Starting from such prior art, it is an object of the invention to improve even more the cooling effect of the backing plate for abrasive flap wheels in order to optimize heat dissipation during operation.

According to the invention, this problem is solved by a backing plate, in which the slots are formed in the outer flange such that they are radially open on its outer edge. Advantageously said slots are also inclined with respect to the radial direction.

These radially open slots provided in the annular outer flange ensure a better cooling and provide for a higher elasticity of the backing plate, which results in higher abrading efficiency and longer endurance of the abrasive flaps with its grains embedded therein and of the entire abrasive flap wheels.

In an advantageous embodiment of the invention, the slots are delimited by a plane baffle surface on their upstream side lagging with respect to the sense of rotation of the backing plate, the baffle surface forming a right angle with the annular fixing surface of the outer flange, wherein opposite to the baffle surface a curved deflection wall is formed.

Such embodiment has the effect that, during rotation of the grinding wheel, cooling air will be circumferentially introduced through the curved deflection wall into the slot where it abuts against the opposite baffle surface on which it is axially deflected toward the annular fixing surface. Here the cooling air abuts the abrasive flaps such that it is finally deviated outside in a radial sense. In this way the heat is dissipated directly on the abrasive flaps.

According to another embodiment of the invention, the outer flange is connected with the dome shaped inner part by means of a conical ring provided with circumferentially distributed aeration slots, which ensure an improved cooling effect.

Finally, the central location hole in the inner part may be formed as a hub having an internal thread for fastening the grinding wheel on the shaft of a driving machine.

BRIEF DESCRIPTION OF THE DRAWINGS

The invention will now be explained in more detail with reference to some embodiments shown in the drawings, in which.

DETAILED DESCRIPTION OF EMBODIMENTS OF THE INVENTION

Figure 1:
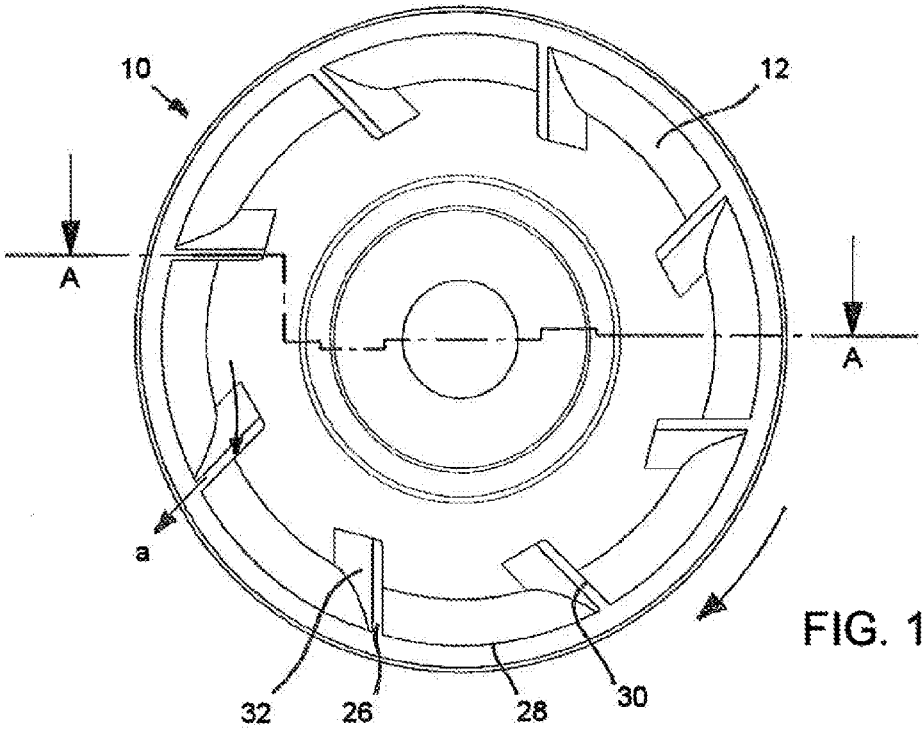
FIG. 1 shows a plan view of a backing plate for abrasive flap wheels according to a first embodiment.
Figure 2:
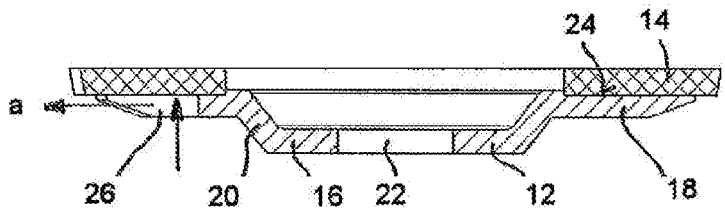
FIG. 2 shows a section along line A-A of FIG. 1.
Figure 3:
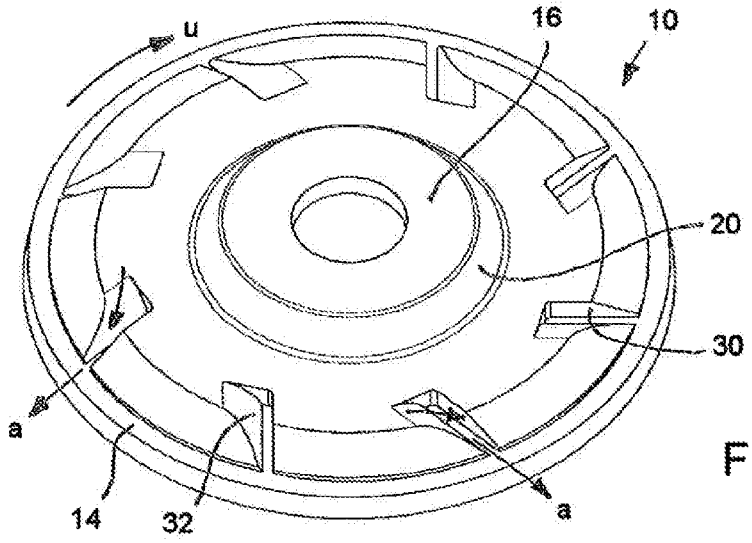
FIG. 3 shows a perspective view of the backing plate.

FIGS. 1 to 3 show a first embodiment of a grinding wheel 10, the circular backing plate 12 of which is already provided with abrasive flaps 14. The backing plate 12 is made of a single synthetic piece, e.g. of polyamide or ABS, which has the advantage of a long life, a sufficient elasticity and poison-less characteristics.

The backing plate 12 is composed of a dome shaped inner part 16 and of an annular outer flange 18, which is an integral part of the inner part 16, to which it is connected by a conical ring 20. The inner part 16 has a central location hole 22 for fastening the backing plate 12 on the shaft of a driving machine.

The abrasive flaps 14 are fastened by bonding on an annular fixing surface 24 (see FIG. 8) of the flange 18 on the opposite side of the inner part 16.

According to the invention, the backing plate 12 is circumferentially provided with openings for the passage of cooling air, which are made of slots 26 formed in the outer flange 18 such that they are radially open on its outer edge 28.

As shown in FIGS. 1 and 3, said slots 26 are inclined with respect to the radial direction. The slots 26 are delimited by plane baffle surfaces 30 on their edge lagging with respect to the rotation sense of the backing plate 12 (upstream) and consequently of the grinding wheel 10. Each baffle surface 30 forms a right angle with the annular fixing surface 24 of the outer flange 18.

In each slot 26, opposite to the baffle surface 30 a curved deflection wall 32 is formed. As shown by the arrows in FIGS. 1 to 3, the air of the environment is drawn through the rotation of the grinding wheel 10 along the deflection wall 32 into each slot 26 where it is guided against the baffle surface 30 to abut the inner side of the abrasive flaps 14. Here the air absorbs the heat of the flaps 14 and is finally deviated outside in a radial sense (see arrows a).

Figure 4:
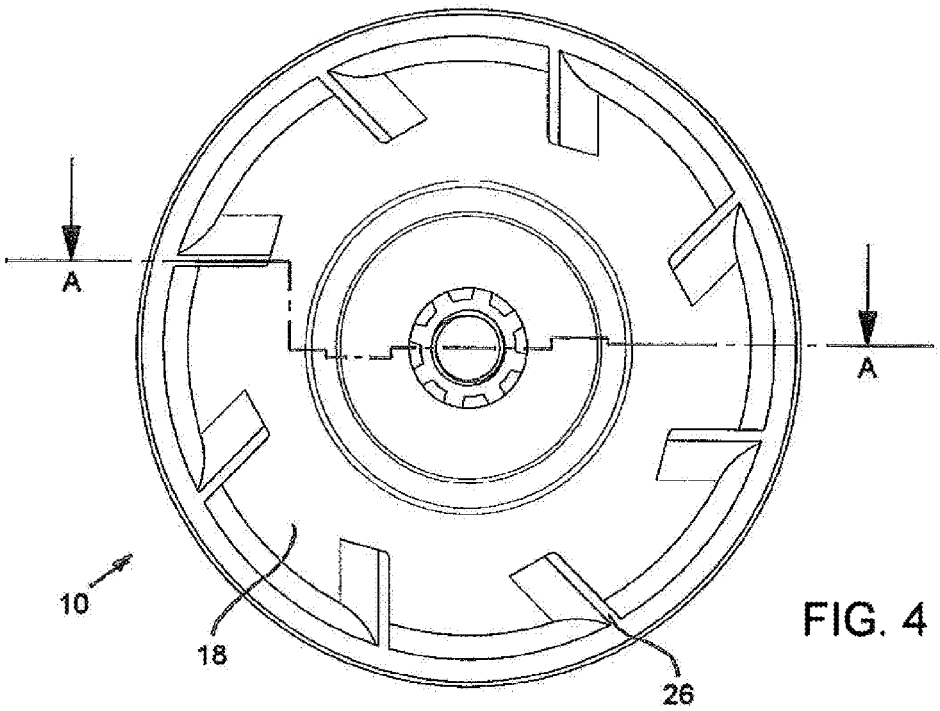
FIG. 4 shows a modified embodiment having a threaded hub for fastening on the shaft of a driving machine.
Figure 5:
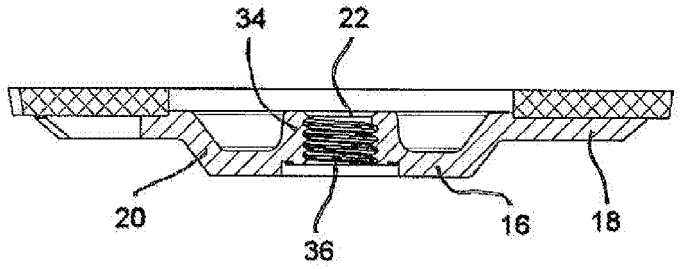
FIG. 5 is a section A-A of FIG. 4.
Figure 6:
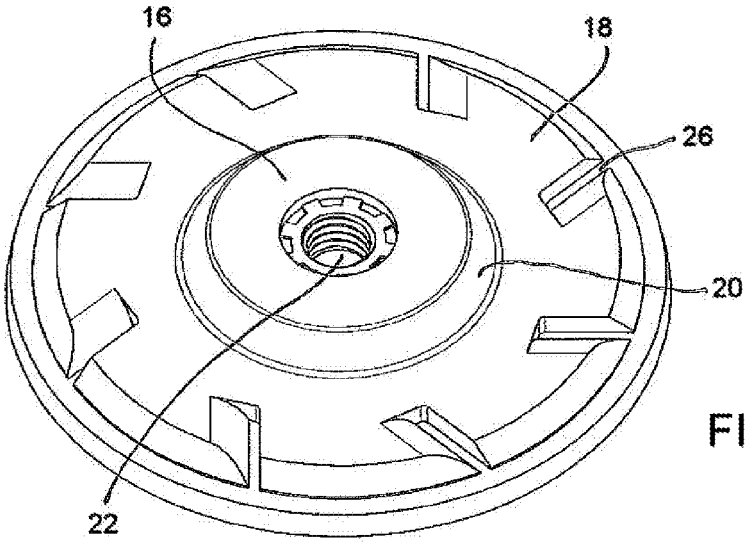
FIG. 6 shows a perspective view of the backing plate of FIGS. 4 and 5.

FIGS. 4 to 6 show a similar backing plate 10 provided with slots 26 for the passage of cooling air. The outer flange 18 is connected with its dome shaped inner part 16 by means of a conical ring 20. The dome shaped inner part 16 is provided with a hub 34, the central location 22 of which has an internal thread 36 for the fastening on the shaft of the driving machine.

Figure 7:
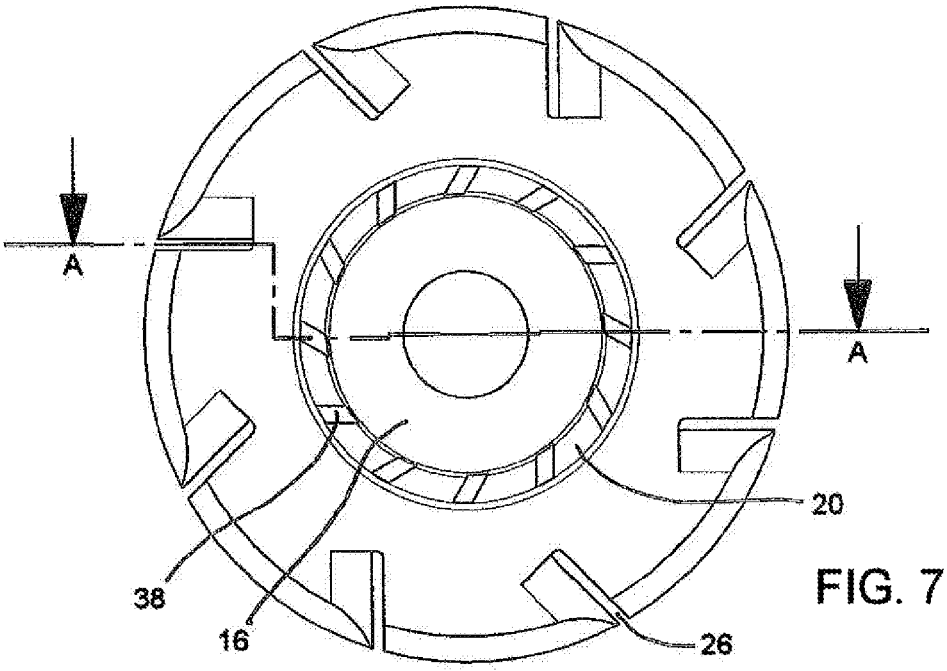
FIG. 7 shows the top view of a further embodiment of the backing plate, wherein the dome shaped inner part is provided with aeration slots.
Figure 8:
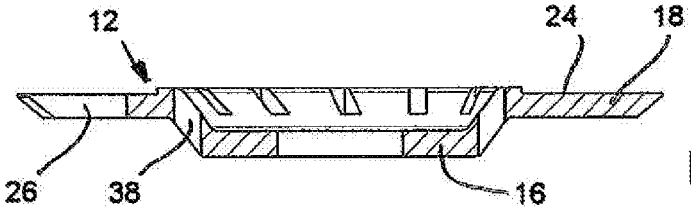
FIG. 8 is a section A-A of FIG. 7.

In the embodiment of FIGS. 7 and 8, the dome shaped inner part 16 of the backing plate 12 is also provided with aeration slots 38 which, similar to the slots 26, are circumferentially distributed and inclined with respect to the radial direction.

Figure 9:
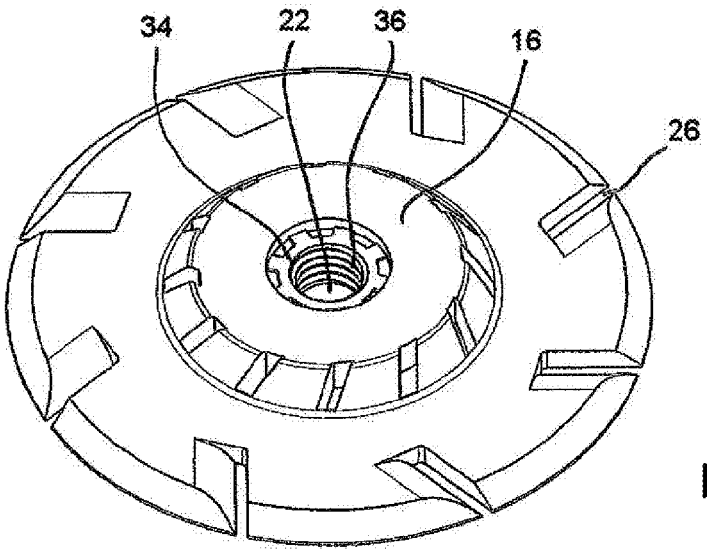
FIG. 9 shows a perspective view similar to FIG. 6.

FIG. 9 shows a further embodiment, according to which the central location 22, similar to FIG. 6, is provided in a hub 34 having an internal thread 36.

The invention claimed is:

1. A backing plate for abrasive flap wheels comprising:

a dome shaped inner part (16) having a central location hole (22) adapted for fastening on a shaft of a driving machine and of an outer flange (18) connected with said inner part (16), said outer flange (18) having an annular fixing surface (24) for abrasive flaps (14) to be bonded thereto, said backing plate (12) being circumferentially provided with openings for passage of cooling air, wherein said openings are configured as slots (26), which are formed in the outer flange (18) and which are radially open on an outer edge (28) of the outer flange (18), and wherein the slots (26) are delimited by a plane baffle surface (30) on an edge of the slots upstream with respect to a rotation sense (u) of the backing plate (12), said baffle surface forming a right angle with said annular fixing surface (24) of the outer flange (18), wherein, opposite to said baffle surface, a curved deflection wall (32) is formed.

2. The backing plate according to claim 1, wherein said slots (26) are inclined with respect to a radial direction.

3. A backing plate for abrasive flap wheels comprising:

a dome shaped inner part (16) having a central location hole (22) adapted for fastening on a shaft of a driving machine and of an outer flange (18) connected with said inner part (16), said outer flange (18) having an annular fixing surface (24) for abrasive flaps (14) to be bonded thereto, said backing plate (12) being circumferentially provided with openings for passage of cooling air, wherein said openings are configured as slots (26), which are formed in the outer flange (18) and which are radially open on an outer edge (28) of the outer flange (18), and wherein said outer flange (18) is connected with the dome shaped inner part (16) by a conical ring (34) provided with circumferentially distributed aeration slots (38).

4. The backing plate according to claim 1, wherein said central location hole (22) is formed in a hub (34) having an internal thread (36) for fastening on the shaft of the driving machine.

* * * * *